US006185844B1

(12) United States Patent
Janzen

(10) Patent No.: US 6,185,844 B1
(45) Date of Patent: Feb. 13, 2001

(54) DISPOSABLE ABSORBENT SHOE INSERT

(76) Inventor: Katherine Janzen, 13 Laydon Drive, St. Albert, Alberta (CA), T8N 2N1

( * ) Notice: Under 35 U.S.C. 154(b), the term of this patent shall be extended for 0 days.

(21) Appl. No.: 09/357,117

(22) Filed: Jul. 19, 1999

(51) Int. Cl.[7] ..... A43B 7/06; A43B 13/38
(52) U.S. Cl. ..... 36/3 B; 36/44
(58) Field of Search ..... 36/43, 44, 3 R, 36/3 B, 71, 1

(56) References Cited

U.S. PATENT DOCUMENTS

| | | | | |
|---|---|---|---|---|
| 321,577 | | 7/1885 | Brown . | |
| 582,670 | | 5/1897 | McWilliam . | |
| 1,926,283 | * | 9/1933 | Herbert | 36/44 |
| 2,121,604 | * | 6/1938 | Lynch et al. | 36/44 |
| 2,451,929 | * | 10/1948 | Dorgin | 36/44 |
| 2,865,097 | * | 12/1958 | Vollrath, Jr. et al. | 36/43 |
| 3,442,031 | * | 5/1969 | Antell | 36/43 |
| 4,257,176 | | 3/1981 | Hartung et al. | 36/44 |
| 4,864,740 | | 9/1989 | Oakley | 36/44 |

* cited by examiner

*Primary Examiner*—M. D. Patterson
(74) *Attorney, Agent, or Firm*—David S. Thompson

(57) ABSTRACT

A pair of disposable absorbent shoe inserts includes first and second inserts, each including a porous upper layer which allows moisture to pass from the user's foot into an absorbent middle layer. A lower surface of the absorbent middle layer is attached to an impervious lower layer 40 which prevents moisture contact with the insole of the shoe. A lower surface of the impervious lower layer is attached to a release material layer 50 having a first pattern. A second shoe insert is similarly constructed, but provides a release material layer having a second pattern which is approximately a reverse image of the first pattern, and is non-overlaying to the first pattern. As a result, each insert acts as a release layer for the other insert. The layers of each insert are ultra thin and are bonded together to form a tapered edge around the circumference of the insert. An adhesive layer 60 is carried between the release layers of the first and second shoe inserts, thereby forming the pair of disposable absorbent shoe inserts. In use, due to the reverse image nature of the release material layers 50, approximately half of the adhesive layer is deposited on the lower surface of each impervious lower layer.

1 Claim, 3 Drawing Sheets

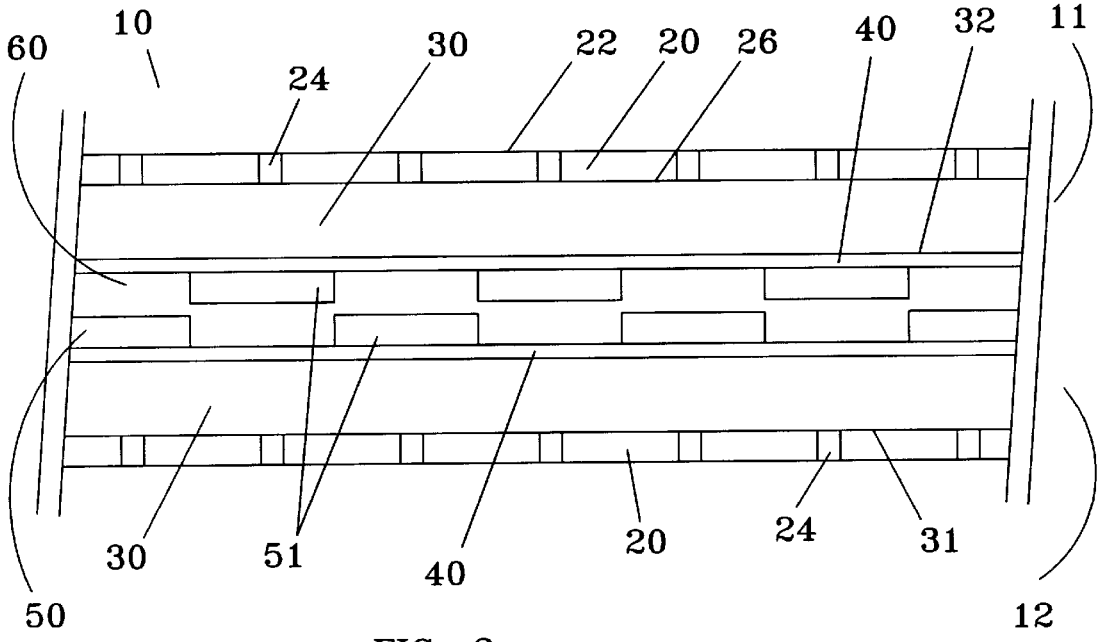
FIG. 3
FIG. 4
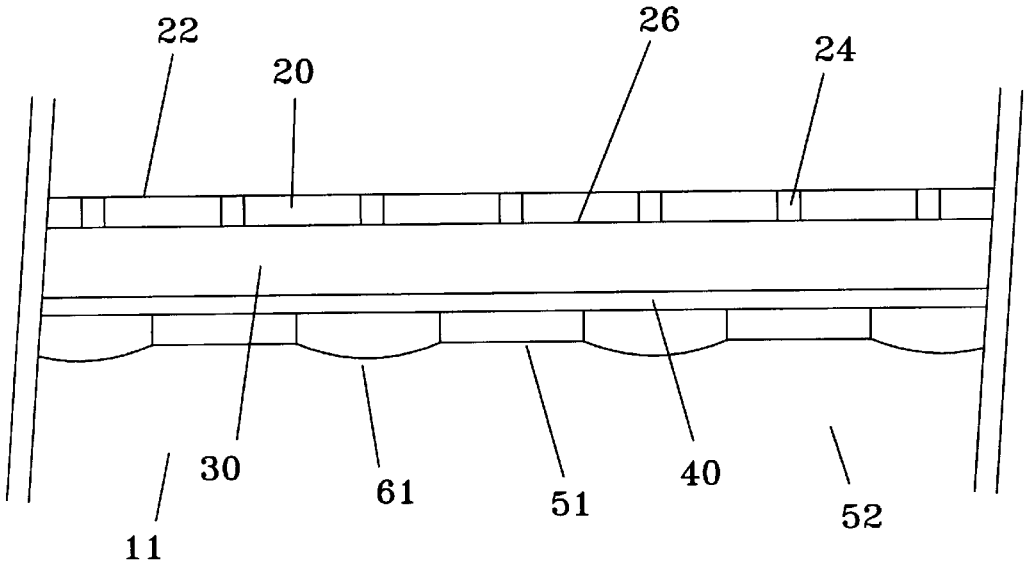

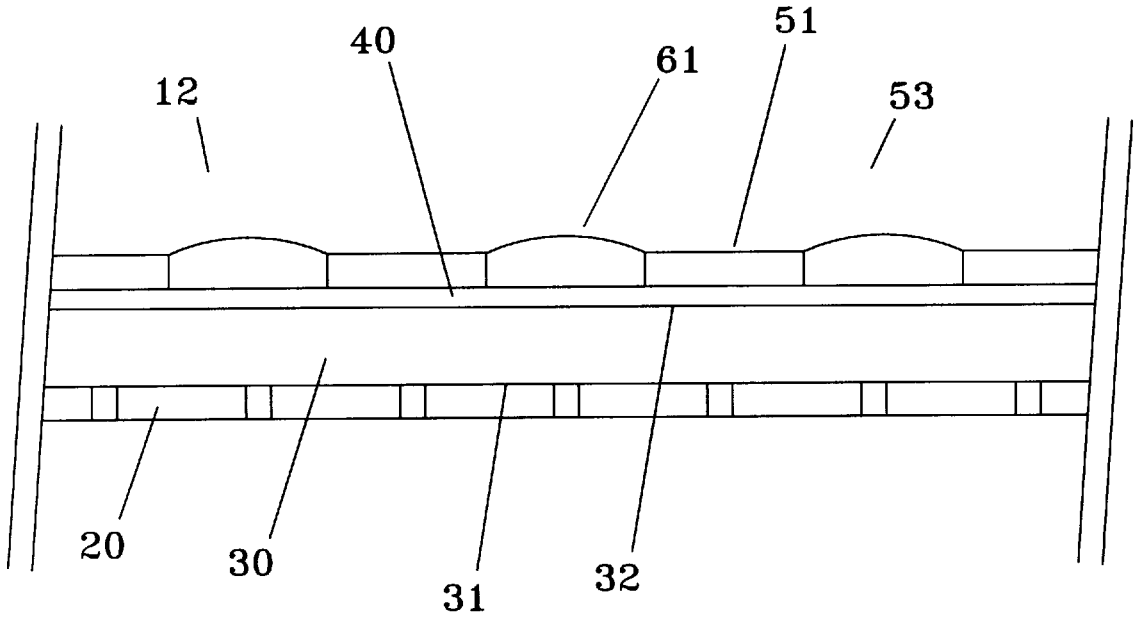
FIG. 5
FIG. 6
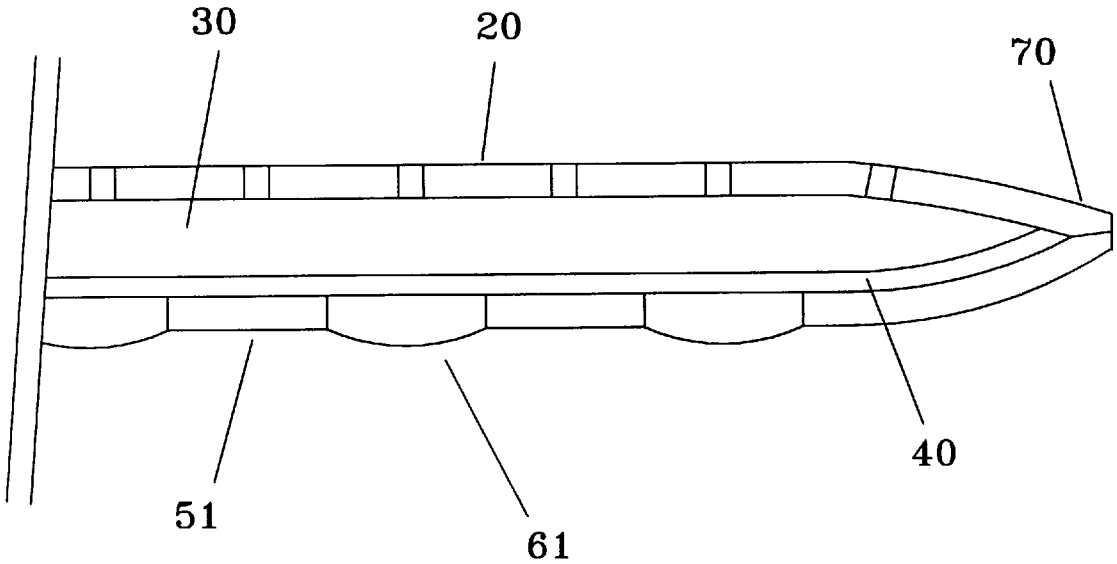

DISPOSABLE ABSORBENT SHOE INSERT

CROSS-REFERENCES

There are no pending applications related to this application, in this or any foreign country.

BACKGROUND

Foot comfort is increased, and shoe life is extended, where perspiration is not allowed to accumulate. Unfortunately, many shoes are made of material that does not breathe, and such shoes are often poorly lined. As a result, perspiration may accumulate, resulting in discomfort, odor and reduced shoe life.

As a result, a number of shoe inserts have been developed. Some have provided a number of layers in attempt to pass, absorb and prevent the flow of moisture. Unfortunately, known shoe inserts have failed to disclose a structure that solves the above problems. A central problem facing the structure of most known inserts is that they are designed to be used over a substantial period of days or months. As a result, the structure is unable to absorb the quantity of moisture that results daily. Similarly, such a structure is actually larger, thicker and less comfortable, since it must be designed to last over time. The expense of such inserts prevents their daily replacement. Much of the expense results from complexity, the need to provide a durable structure and also the need to provide and inventory differently sized inserts for differently sized shoes.

As a result, what is needed is a disposable absorbent shoe insert which is designed for convenient one-day use only, which is highly absorbent, and which is inexpensive to manufacture.

SUMMARY

The present invention is directed to an apparatus that satisfies the above needs. A novel disposable absorbent shoe insert is disclosed that is highly absorbent, inexpensive enough for daily replacement, thin enough and with a tapered edge so that accurate sizing is not necessary for user comfort, and which is easily inserted and removed from shoes of all sizes. A preferred version of the disposable absorbent shoe insert includes some or all of the following structures.

(A) First and second shoe inserts are attached together in a retail packaging configuration and are peeled apart for installation in left and right shoes. A preferred shoe insert includes:

(a) An upper porous layer, typically made of a polyester film or similar material, defines a large number of small holes, thereby allowing moisture to pass through the upper porous layer.

(b) An absorbent middle layer is made of a highly absorbent material, typically similar to that used in the construction of feminine napkins.

(c) A moisture impervious lower layer prevents shoes' insoles from continuous contact to moisture carried in the absorbent middle layer.

(d) A release material layer provides strips of adhesive resistant material distributed in a pattern to the lower surface of the moisture impervious lower layer, wherein the release material pattern on the first and second shoe inserts are substantially reverse images.

(B) An adhesive layer is carried between the first and second shoe inserts.

It is therefore a primary advantage of the present invention to provide a novel disposable absorbent shoe insert which is highly absorbent and thin, and which is therefore adapted to absorb moisture for one day in even the tightest fitting shoes.

Another advantage of the present invention is to provide a novel disposable absorbent shoe insert that provides a porous upper layer which allows the passage of moisture, an absorbent middle layer which absorbs moisture readily, an impervious lower layer which prevents moisture from contacting the insole of the user's shoe and a release material layer consisting of strips of release material covering a portion of the area of the impervious lower layer.

A still further advantage of the present invention is to provide a novel retail packaging configuration for a pair of disposable absorbent shoe inserts which includes an adhesive layer between the release material layers of adjacently positioned left and right shoe inserts. The operational advantage is that in separating the left and right inserts, the adhesive layer adheres to the portion of the lower surface of each impervious lower layer which is not covered with release material, thereby allowing each shoe insert to act as the release covering of the other shoe insert's adhesive.

DRAWINGS

These and other features, aspects, and advantages of the present invention will become better understood with regard to the following description, appended claims, and accompanying drawings where:

FIG. 3 is a cross-sectional view of a pair of disposable absorbent shoe inserts.

FIG. 4 is a cross-sectional view of a first of the pair of disposable absorbent shoe inserts, wherein the release material layer has a first pattern.

FIG. 5 is a cross-sectional view of a second of the pair of inserts, wherein the release material layer has a second reverse image pattern.

FIG. 6 is a cross-sectional view of the edge of an insert, illustrating the tapered nature of the edge of the shoe insert.

DESCRIPTION

Figure 1:
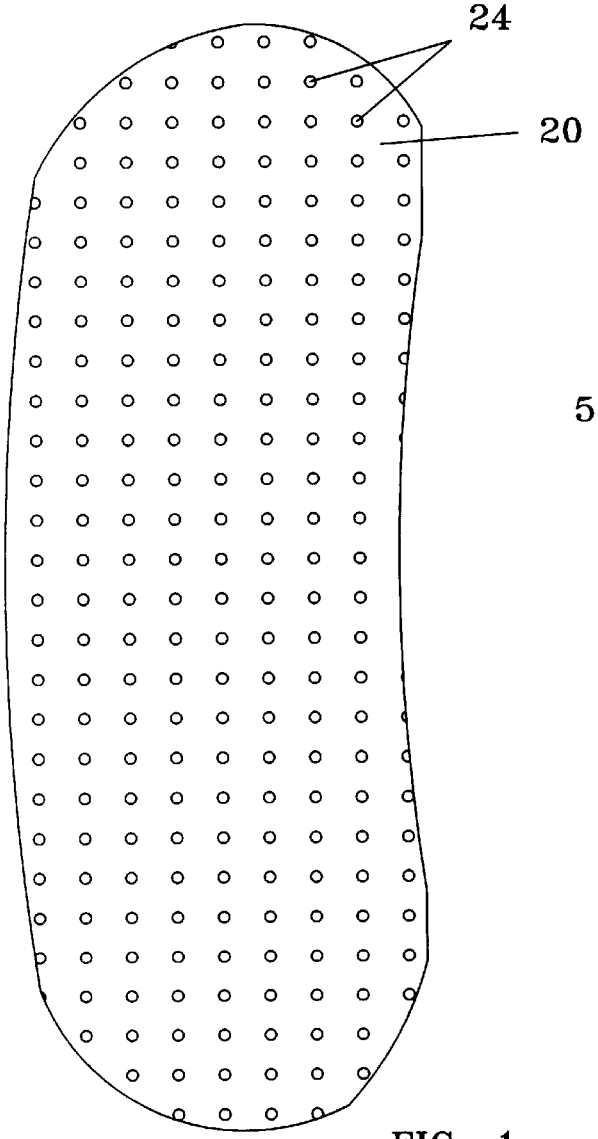
FIG. 1 is a top orthographic view of a version of the disposable absorbent shoe insert.
Figure 2:
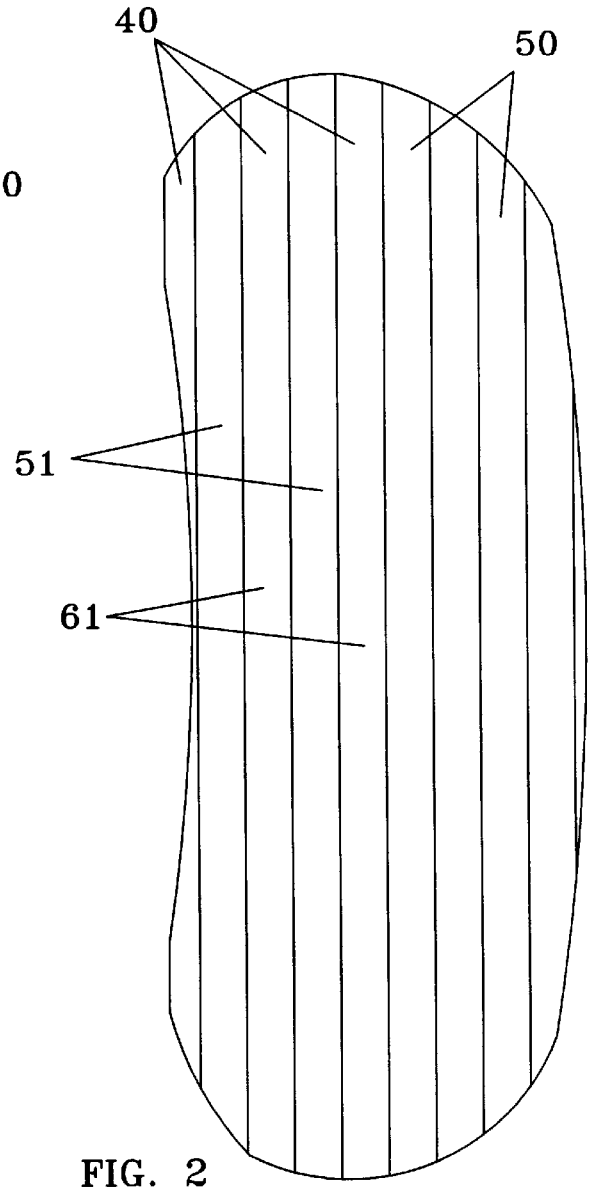
FIG. 2 is a bottom orthographic view of the disposable absorbent shoe insert of FIG. 1.

Referring generally to FIGS. 1 through 6, a pair 10 of disposable absorbent shoe inserts constructed in accordance with the principles of the invention is seen. A preferred version of a first shoe insert includes a porous upper layer 20 which allows moisture to pass from the user's foot into an absorbent middle layer 30. A lower surface of the absorbent middle layer is attached to an impervious lower layer 40 which prevents moisture contact with the insole of the shoe. A lower surface of the impervious lower layer is attached to a release material layer 50 having a first pattern. A second shoe insert is similarly constructed, but provides a release material layer having a second pattern which is approximately a reverse image of the first pattern, and is non-overlaying to the first pattern. As a result, each insert acts as a release layer for the other insert. The layers of each insert are ultra thin and are bonded together to form a tapered edge around the circumference of the insert. An adhesive layer 60 is carried between the release layers of the first and second shoe inserts, thereby forming the pair of disposable absorbent shoe inserts. In use, due to the reverse image nature of the release material layers 50, approximately half of the adhesive layer is deposited on the lower surface of each impervious lower layer.

As seen in FIGS. 1 and 3 through 6, a porous upper layer 20 allows moisture passage through holes 24 from the user's foot or sock into the highly absorbent middle layer 30.

An upper surface 22 of the porous upper layer is in contact with the user's foot, while a lower surface 26 is adjacent to the absorbent middle layer.

The material from which the porous upper layer is made should be selected for durability. It is generally not desirable that the layer be absorbent, since that would place a water-containing layer adjacent to the user's foot. Polyester film may be used, or other similar materials.

As seen in FIGS. 3 through 6, an upper surface 31 of a highly absorbent middle layer 30 is adjacent to the lower surface 26 of the upper porous layer 20. The highly absorbent middle layer absorbs the moisture passing through the holes 24 of the porous upper layer.

The highly absorbent middle layer may be made of a variety of known absorbent materials, and a preferred version of the layer is made of material similar to that used in feminine napkins. Such material is adapted for disposable use, and is highly absorbent. Antifungal agents, deodorants and other known additives may be incorporated into versions of this layer. Due to the disposable nature of the preferred version, the layer 30 may be quite thin, and is typically about ⅛" thick when uncompressed and much thinner when in use.

As seen in FIGS. 2 through 6, a moisture impervious lower layer 40 is attached to a lower surface 32 of the highly absorbent middle layer 30. The moisture impervious lower layer is typically plastic film, having sufficient rigidity to allow attachment of the shoe insert to the insole of the user's shoe.

As seen in FIGS. 3 through 6, a release material layer 50 is carried by all or part of the lower surface of the impervious lower layer, and provides at least one release material strip 51, and typically a plurality of strips. The release material layer carried by the first shoe insert is the reverse image of the release material layer carried by the second shoe insert.

The functional purpose of the release layer is to provide a first pattern 52 on the first shoe insert, and a second pattern 53 on the second shoe insert, in which there is no adhesive after the first and second shoe inserts are separated. Thus, after separation, each shoe insert has distributed on it approximately half of the adhesive layer, and is therefore ready for attachment to the appropriate shoe's insole. As a result, each shoe insert acts as the release material layer for the other shoe insert, thereby reducing cost.

The release material layer is so named because it is only very slightly adhered to by the adhesive layer. As a result, gentle separation of the release layer with respect to the adhesive layer 60 tends to "release" the adhesive layer. Due to the release layer's resistance to adhesion with the adhesive layer, when the adhesive layer separates from the release layer, the release layer is clear of adhesive material. The adhesive material is left on the lower surface of the impervious layer. Since the release material strips 51 are offset, or reverse images, in the separation process the adhesive layer will adhere to the bottom of the impervious lower layer 40, and will separate from the release material strip 51.

The material used to form the release material layer 50 may be of any conventional release materials, such as wax-based coatings that tend to adhere to materials, such as the lower surface of the impervious lower layer, but which resist most adhesives.

Such a waxed-based release material could be sprayed on the lower surface of the imperious lower layer 40 of the first and second inserts in an offset or reverse image pattern of strips 51, as seen in FIG. 3.

As seen in FIGS. 2 through 6, an adhesive layer 60 is carried between the opposed release material layers, and the lower surface of the impervious lower layers 40, of the first and second shoe inserts. The adhesive layer may cover all or part of the opposed release material layers and impervious lower layers.

The adhesive should be should be selected for its ability to adhere only weakly to the release strips 51, and for its ability to hold in a non-permanent manner to the insole of the user's shoe.

Alternatively, an adhesive layer 60 could be applied to all or part of each of the lower surfaces of the impervious layers 40 of a facing pair of shoe inserts. In this circumstance, the adhesive layers would be separated by a disposable release layer, typically made of paper or plastic coated on both sides with release material.

As seen in FIG. 6, the porous upper layer 20 and impervious lower layer 40 are pressure-crimped or heat-welded together, thereby causing the edge of each shoe insert 11, 12 to form a taper 70. The thinness of the insert, combined with the tapered edges, allows the use of inserts that conform only very approximately to the outline of the insole of the shoe, without sacrificing performance or comfort. The first and second inserts 11, 12 forming the pair of inserts 10 may be shaped similarly if there is a cost advantage, or may be shaped very generally to conform to left and right shoes. Similarly, a one-size-fits-all strategy may be used, or several sizes can be manufactured.

In operation, a pair 10 of disposable absorbent shoe inserts is constructed, with an adhesive layer 60 between the first and second shoe inserts 11, 12, as seen in FIG. 3. The user gently separates the two shoe inserts, resulting in two separate inserts, as seen in FIGS. 4 and 5, with alternating adhesive strips 61 and release material strips 51, in offset or reverse image patterns 52, 53.

The user then applies the adhesive layer carried by each insert to the insole of the user's shoe. After wearing for one day, the user may then remove the inserts by simply overcoming the adhesive layer attaching each insert to the shoe insole.

The previously described versions of the present invention have many advantages, including a primary advantage of providing a novel disposable absorbent shoe insert which is highly absorbent and thin, and which is therefore adapted to absorb moisture for one day in even the tightest fitting shoes.

Another advantage of the present invention, due to its thinness and its tapered edge, is to provide a novel disposable absorbent shoe insert that does not require careful and accurate sizing to fit the user's shoe. The user may comfortably employ an insert that only approximately covers the insole of the shoe, or that is hurriedly installed in a somewhat imprecise manner. This provides increased convenience to the user, and reduces cost since fewer sizes and shapes need to be manufactured.

Another advantage of the present invention is to provide a novel disposable absorbent shoe insert that provides a porous upper layer which allows the passage of moisture, an absorbent middle layer which absorbs moisture readily, an impervious lower layer which prevents moisture from contacting the insole of the user's shoe and a release material layer consisting of strips of release material covering roughly 50% of the area of the impervious lower layer.

A still further advantage of the present invention is to provide a novel retail packaging configuration for a pair of disposable absorbent shoe inserts which includes an adhesive layer between the release material layers of adjacently positioned left and right shoe inserts. The operational advantage is that in separating the left and right inserts, the adhesive layer adheres to the portion of the lower surface of each impervious lower layer which is not covered with release material, thereby allowing each shoe insert to act as the release covering of the other shoe insert's adhesive.

The invention resides not in any one of these features per se, but rather in the particular combination of all of them herein disclosed and claimed and it is distinguished from the prior art in this particular combination of all of its structures for the functions specified.

Although the present invention has been described in considerable detail and with reference to certain preferred versions, other versions are possible. For example, while certain preferred materials have been disclosed, it is clear that alternative materials could be substituted while still in keeping with the teachings of the invention. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A pair of disposable absorbent shoe inserts attached together in a retail packaging configuration, comprising:

(A) a first shoe insert, comprising:

(a) an upper porous layer, defining a large number of small holes, through which moisture is able to pass;

(b) a highly absorbent middle layer having an upper surface adjacent to the upper porous layer;

(c) a moisture impervious lower layer, adjacent to a lower surface of the highly absorbent middle layer; and (d) a release material layer comprising strips of adhesive resistant material attached in a first pattern to the lower surface of the moisture impervious lower layer;

(B) a second shoe insert, comprising:

(a) an upper porous layer, defining a large number of small holes, through which moisture is able to pass;

(b) a highly absorbent middle layer having an upper surface adjacent to the upper porous layer;

(c) a moisture impervious lower layer, adjacent to a lower surface of the highly absorbent middle layer; and (d) a release material layer comprising strips of adhesive resistant material attached in a second pattern to the lower surface of the moisture impervious lower layer, wherein the first and second patterns are substantially reverse images; and (C) an adhesive layer carried between the first and second shoe inserts.

* * * * *